United States Patent [19]

Cope

[11] 4,161,108

[45] Jul. 17, 1979

[54] METHOD AND APPARATUS FOR REDUCING THE TEMPERATURE OF A FLUID

[75] Inventor: Louis T. Cope, Grayson, Ga.

[73] Assignee: H&T Enterprises, Inc., Grayson, Ga.

[21] Appl. No.: 854,814

[22] Filed: Nov. 25, 1977

Related U.S. Application Data

[62] Division of Ser. No. 659,122, Feb. 18, 1976, Pat. No. 4,094,164.

[51] Int. Cl.[2] ..... B01F 3/04; F25C 1/18; F25D 3/12

[52] U.S. Cl. ..... 62/306; 62/307; 62/388

[58] Field of Search ..... 261/DIG. 7; 62/74, 121, 62/306, 307, 384, 388, 386, 387, 514 R, 69, 70

[56] References Cited

U.S. PATENT DOCUMENTS

| | | | |
|---|---|---|---|
| 1,712,701 | 5/1929 | Hassensall | 62/306 |
| 2,440,930 | 5/1948 | Camilli et al. | 62/307 |
| 2,449,005 | 9/1948 | Nicholas | 62/388 |
| 2,751,762 | 6/1956 | Colton | 62/74 |
| 2,759,336 | 8/1956 | Seefeldt | 62/307 |
| 2,951,351 | 9/1960 | Snelling | 62/514 R |
| 3,319,344 | 5/1967 | Sachsel et al. | 62/74 |

*Primary Examiner*—Lloyd L. King
*Attorney, Agent, or Firm*—Patrick F. Henry

[57] ABSTRACT

The present method may be employed to reduce the temperature of water including chilling or freezing the water to produce ice and slush and simultaneously therewith keeping the water in motion, as from one container to another, without the use of a circulating pump. Liquid carbon dioxide is used as an expendable refrigerant by releasing same continuously beneath the water and then the activity of the conversion of the carbon dioxide changing from a liquid to a solid and gas is applied in a confined space to circulate the water as a liquid heat exchange medium.

The basic apparatus comprises a large container of water in which are one or more conduits or stacks at the bottom of which are holes admitting the water to be chilled. A $CO_2$ nozzle receives liquid $CO_2$ and a pressurized supply tank discharges the $CO_2$ as a solid and gas through the nozzle which receives the $CO_2$ as a liquid and the release into the confined area pushes the fluid through the conduits or stacks thereby circulating same in a tank to reduce the temperature and to keep the fluid in motion.

12 Claims, 5 Drawing Figures

METHOD AND APPARATUS FOR REDUCING THE TEMPERATURE OF A FLUID

This is a division of application Ser. No. 659,122 filed Feb. 18, 1976, now U.S. Pat. No. 4,094,164.

BACKGROUND OF THE INVENTION

1. Field of the Invention

Refrigerating methods and apparatus and especially those which may use the release of liquid such as $CO_2$ into gaseous $CO_2$.

2. Description of the Prior Art

Prior art of course includes numerous methods and apparatus for refrigerating a liquid such as water. The conventional methods and apparatus employ the well-known gas refrigerating cylce whereby gas is compressed and expanded inside of coils to produce a lowering of the temperature. The initial investment in such equipment is quite high and the operating cost is significant. Many establishments such as food processing plants, especially those handling fresh seafood such as oysters and clams, do not have the necessary investment capital to provide sufficient chilled water. The thermodynamic principles of carbon dioxide ($CO_2$) as a liquid, solid and/or gas is well known. The release of pressurized [liquid]$CO_2$ causes an endothermic reaction and the release of $CO_2$ gas in motion. The present method utilizes expendable $CO_2$ gas which can be purchased as needed and the initial investment is relatively small compared with conventional refrigerating equipment whereas the chilling and freezing takes place rapidly and the equipment is shut down quickly and restarted with a minimum of difficulty.

SUMMARY OF THE INVENTION

An object of the present invention is to provide both a method and means for refrigerating liquids such as water with a considerable less initial investment than conventional refrigerating equipment.

According to the present invention, liquid carbon dioxide ($CO_2$) as an expendable refrigerant is permitted to change to a solid and gas by release in a space in which a fluid medium such as water is circulating and then the force of the release of the gas is utilized to move the medium and to reduce the temperature of same, thereafter the gas is removed by means of suitable conduit to the atmosphere.

An object of the present invention is to use liquid carbon dioxide as an expendable refrigerant thereby resulting in large quantities of $CO_2$ vapor being evolved. The apparatus is constructed for the removal of vapors by pressure venting to the atmosphere by the use of an exhaust fan or fans.

The present invention provides an apparatus which can be used to simultaneously chill a fluid media and transfer the fluid media from one container to another without the aid of a pump.

The present apparatus may be used to make large quantities of ice slush and transfer same from one container to with the aid of a conventional conveyor.

Another advantage of the present apparatus resides in the easy removal of waste $CO_2$ gas to the outside.

Other and further objects and advantages of my invention will become apparent upon reading the following specification taken in conjunction witht the accompanying drawings, in which.

DESCRIPTION OF A PREFERRED METHOD AND EMBODIMENT

Figure 1:
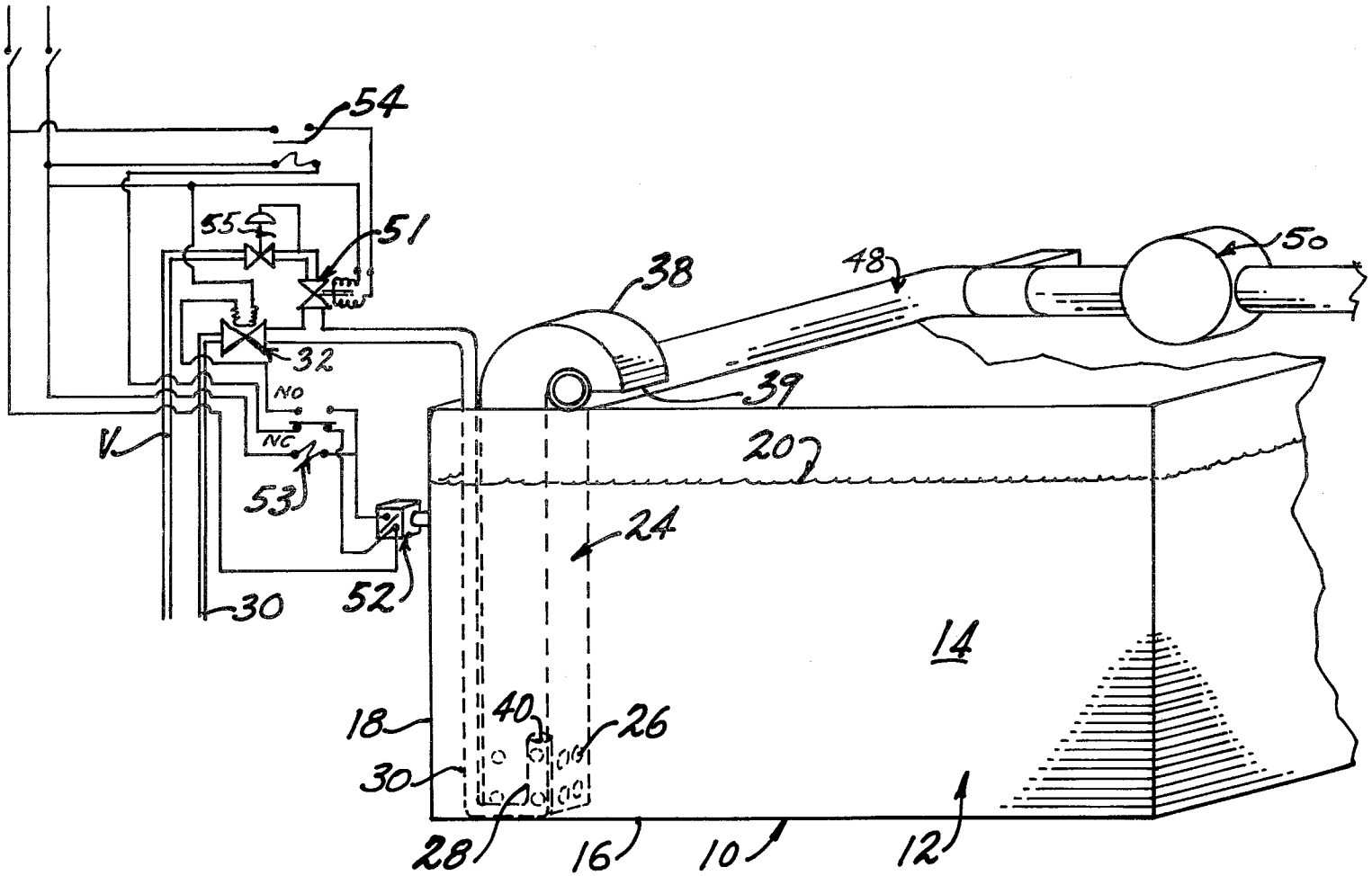
FIG. 1 is a diagrammatic view of a basic apparatus for the practice of the present method.

With reference to the diagrammtic view shown in FIG. 1, a basic apparatus designated generally by reference numeral 10 comprises a cabinet defining a closed tank or vat designated generally by reference numeral 12 and which may be manufactured from stainless steel or other metal plate having sides 14, bottom 16, ends 18 and a removable top not shown. Water 20 under pressure from a suitable city water system or other source is supplied to the tank 12 and maintined at a water level by any suitable method of drain and control such as a float control system. A plurality of vertical stacks or conduits 24 which may be constructed from stainless steel sheets each has a submerged lower portion provided with a plurality of openings or holes 26 well below water level which admit the fluid water 20 being chilled inside the conduit 24. A $CO_2$ gas nozzle 28 is located within the bottom of the stack or conduit 24 and is connected by a suitable line 30 to a source of $CO_2$ liquid gas electrically controlled through a solenoid control valve 32. The vertical conduit 24 is provided with a 180° bend at the top 38 thereof and an outlet 39. The nozzles 28 have the orifice 40 thereof above the incoming openings 26 and liquid carbon dioxide at equilibrium temperature and pressure which is usually around 0° F. and 290 P.S.I. supplied to the line 30. The orifice 40 in the nozzle 28 admits carbon dioxide as a liquid and on discharge the liquid carbon dioxide changes to a solid and a gas and blows the water 20 upwardly in the conduit 24 which acts as a stack. The heat in the water 20 inside the stack 24 causes the solid $CO_2$ particles to sublime by the time the solution reaches the upper section of the conduit 24. The chilled fluid 20 is then forced to make the 180° turn and the force behind the fluid is sufficient to cause the water to hold to the outer radius of the turn and thereafter empty as directed. The expendable $CO_2$ gas which is no longer being used is removed by means of a conduit system 48 which is connected to a fan venting system 50.

A vapor sweep cycle may be employed to prevent accidental formation of solid $CO_2$ in the line between the shut-off valve 32 and the nozle 28 which in some cases can be dangerous due to the pressures which can result. Whenever the valve 32 is closed the pressure in the line 30 drops (the rate of dropping depending upon the size of the discharge nozzle 28 and the amount of heat that is entering the hose or pipe). For example, if the pressure drops rapidly below 60.4 psi the liquid will change to solid and stop up the line 30 which can burst the line 30 or below ice out the end. To prevent this vapor a sweep solenoid valve 51 in an open line is used in the line 30 and is caused to open to keep the pressure in the line 30 below 60.4 psi until all liquid has been discharged whereupon the vapor shuts off. A temperature control switch 52 is closed, thereby calling for cooling, completing a circuit to the coil of a relay 53 which has one normally closed and one normally open set of contacts. The normally open contacts close to complete the circuit to the inlet solenoid control valve 32. When the cooling cycle is complete the switch 52 opens the relay 53 contacts to normally closed whereupon solenoid valve 32 closes making a circuit to the coil of a time delay relay switch 54 closing the time delay contacts for a predetermined period (usually a few seconds) thereby opening the vapor solenoid valve 51 which sweeps the liquid $CO_2$ in line 30 from a vapor line V. At the end of the time the contacts on the time delay relay 54 contacts open and the vapor solenoid valve 51 closes. The time delay switch 54 resets on interruption of power to the coil as when the contacts on the temperature control 52 close. A pressure regulator 55 regulates the $CO_2$ vapor supply from about 300 psi to about 100 psi but the use of the regulator 55 is optional and would conserve $CO_2$ used to sweep line 30.

EXAMPLE

An open vat of a brine solution was placed in a vat such as the tank 12 in FIG. 1 and liquid carbon dioxide at approximately 0° F. and 291 psi was connected and delivered through a line such as line 30 in FIG. 1. $CO_2$ gas was admitted through the nozzle, such as nozzle 28 in FIG. 1, and emitted from the orifice, such as orifice 40, in FIG. 1, and the brine solution was chilled from approximately 65° F. to 0° F.

Figure 2:
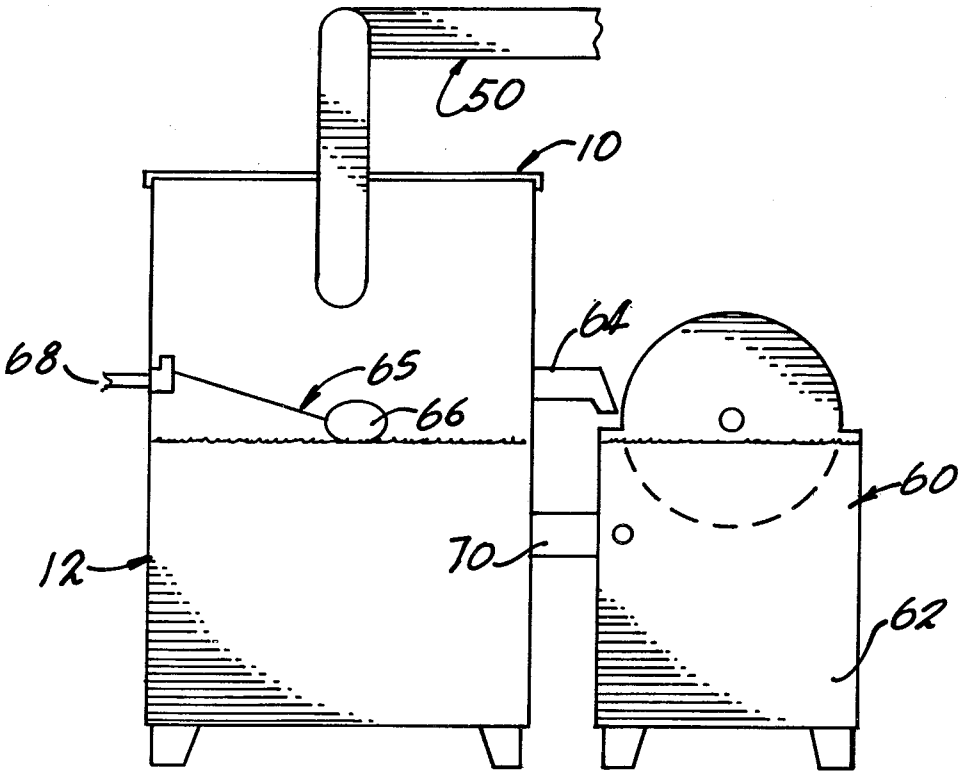
FIG. 2 is a second diagrammatic view of the present apparatus in conjunction with a conventional clam washer.

In FIG. 2 the apparatus 10 is shown in conjunction with a conventional machine 60 known as a clam washer which is used by seafood places to wash and chill clams. Clam washer 60 comprises a tank 62 containing clams in chilled water. The apparatus 10 feeds the chilled water into tank 62 by means of a chute 64 beneath outlet 39. The level of the water in tanks 12 and 62 is controlled by means of an electric float valve 65 comprising a float 66 and an inlet water connection 68 controlled by valve 65. The water is caused to circulate from the colder water entering from chute 64 moving the warmer water inside tank 62 thru a return pipe 70 connected between tanks 12 and 62.

Figure 3:
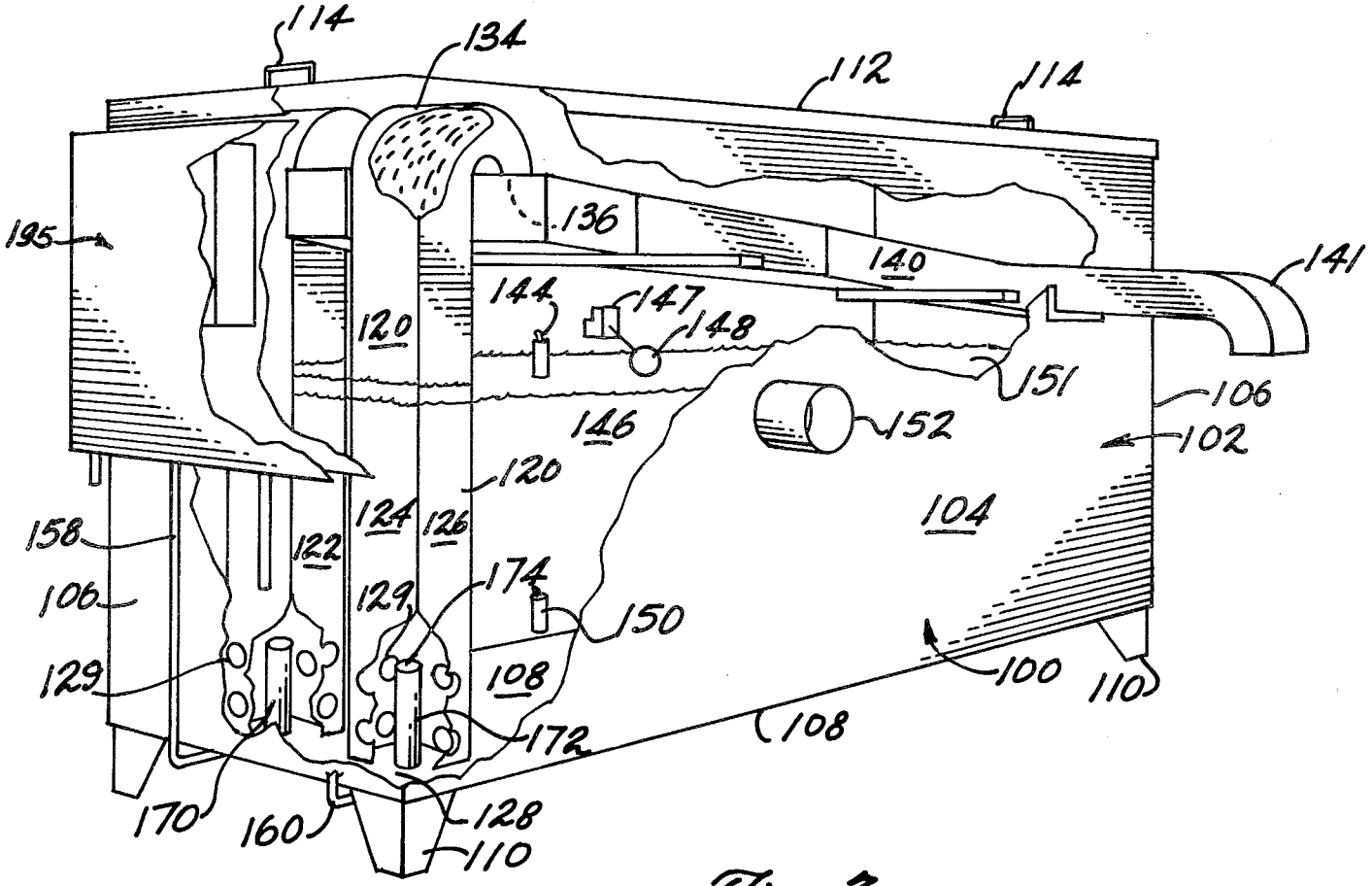
FIG. 3 is a perspective view of a preferred form of the present apparatus which is used to chill water or other fluids with part of one end broken away.

Referring to the apparatus shown in FIG. 3 which can be used as a chiller unit and connected to existing clam washers, the apparatus is designated generally by reference numeral 100 and comprises a tank or vat designated generally by reference numeral 102 which has two slides 104 and two ends 106 supported and sealed together about a bottom 108 resting on floor legs 110. A removable tank top 112 is provided with handles 114 to provide access to the interior of the tank, or vat 102. A pair of vertical conduits, ducts or stacks 120 and 122 of identical construction comprise sides 124 and ends 126 having an open bottom 128 resting on the bottom 108 of tank conduits 120, 122 have liquid openings 129 therein near the bottom 108 of tank 102. The top of the vertical conduit or duct 120 is formed with a closed 180° bend 134 leading to an open mouth 136 exhausting into a trough 140 having a chute 141.

An electrical float switch 144 within tank 102 senses the upper level of the water 146 in the tank 102 to activate an electrical circuit discussed later. A float valve 147 with float 148 provides the control for the additional supply of water into the tank 102. Another float switch 150 at the lower level controls the gas. The chilled water (or other liquid refrigerant as the cas may be) 151 is circulated out through an outlet 152.

Figure 4:
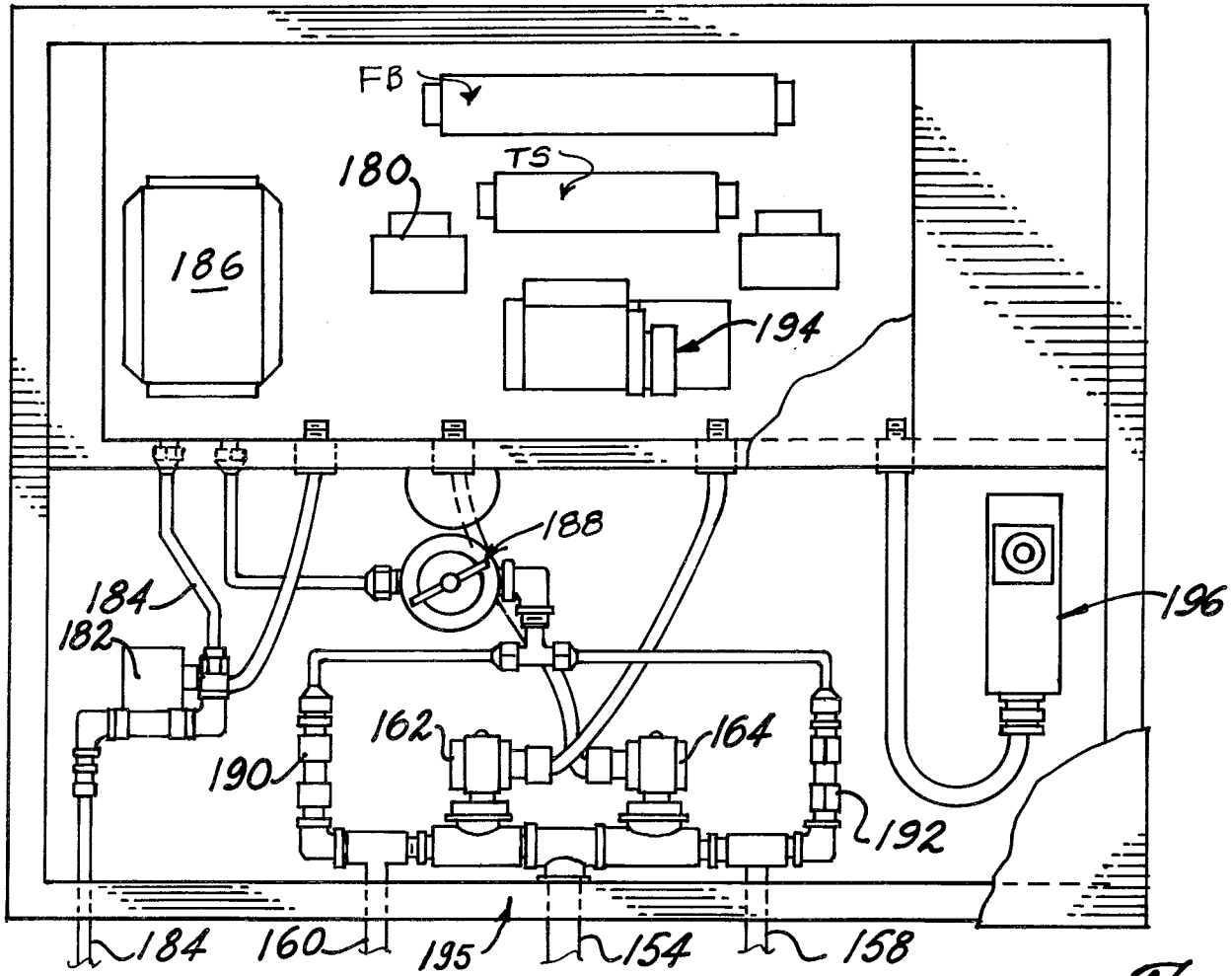
FIG. 4 is an elevation view of part of the end of the device shown in FIG. 2 with the cabinet open.
Figure 5:
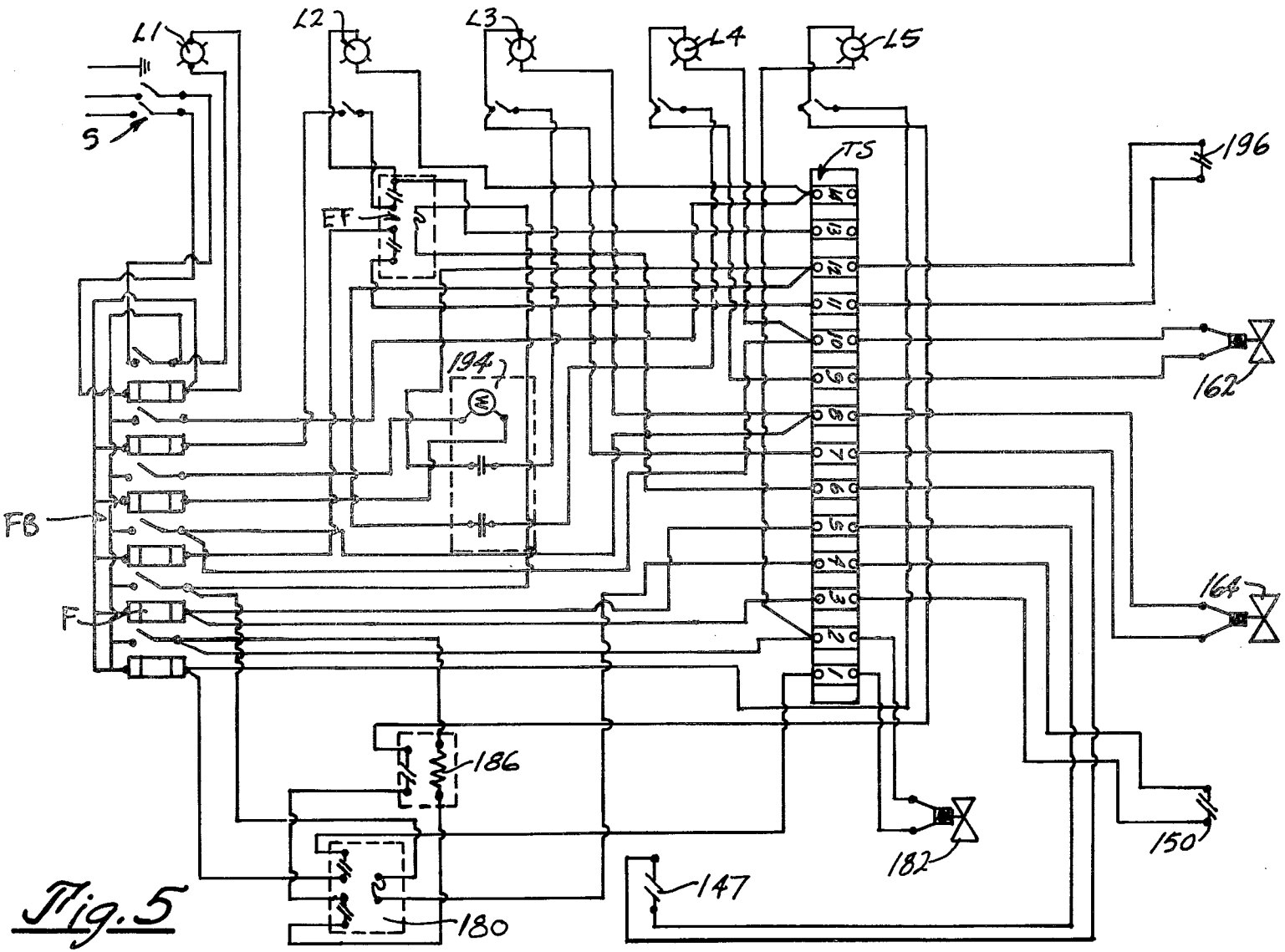
FIG. 5 is a schematic circuit diagram of the electrical layout for the device shown in FIG. 2.

The liquid $CO_2$ is supplied from a pressurized source, such as a tank, through a main line 154 (see FIGS. 3 and 4) which is connected to two separate lines 158, 160 through solenoid control valves 162, 164 controlled electrically from wires 166 as seen in the electrical diagram in FIG. 5. The respective $CO_2$ lines 158, 160 lead to respective $CO_2$ nozzles 170, 172 which have the outlets 174 thereof above the level of the liquid openings 129 but of course below the level of the water 151.

A small amount of $CO_2$ vapor is deliberately permitted and allowed to escape from outlets 174 in respective nozzles 170, 172 so as to prevent water from entering the nozzles 170, 172. When the water level in the tank 102 activates the float switch 150 a circuit is made which supplies voltage to a relay 180 closing same making a circuit to the vapor solenoid 182 which controls a vapor line 184 delivering vaporized $CO_2$ to a heater 186 thence to a pressure reducing valve 188 and thru check valves 190, 192 through the $CO_2$ lines 158, 160 and respective nozzles 170, 172 allowing a small amount of the vaporized $CO_2$ to escape which prevents any water from entering the nozzles 170, 172.

With reference to the circuit diagram in FIG. 5 and the other FIGURES of the drawings, a fuse block FB has individual fuses F for separate circuits. A main power switch S is connected to a light L1. There is also a fan control light L2 indicator, a pair of indicator lights L3 and L4 for respective solenoids 162, 164 and a vapor heater 186 indicator light L4. The various circuits and corresponding wires are connected to a terminal strip TS having numbered portions 1, 2 etc. An exhaust fan (not shown) in connection with the surplus and released gas from duct 120, in the manner described in connection with FIG. 1 is operated by a relay control EF to exhaust unwanted gas and fumes.

Upon the water level reaching the float switch 144 a circuit is made applying voltage to the coil of relay 180 closing same thereby supplying voltage to one normally open and one normally closed set of contacts on an interval timer 194 alternatively opens and closes the valves 162, 164 at preset intervals so that when valve 162 is open the valve 164 is closed so that liquid $CO_2$ is admitted to nozzle 172 (during the time that the liquid $CO_2$ flows thru nozzle 172*a* small amount of relatively warm $CO_2$ vapor is flowing thru nozzle 170 and vice versa). Liquid $CO_2$ being discharged thru the nozzle 172 (or nozzle 170 as the case may be) blows the water 151 upwardly in the stack 120 and during the upward travel thereof the heat is removed from the water by the evaporation and sublimation of the $CO_2$. The total cooling efficiency is reached and accomplished as the temperature of the exhaust gas is the same as the water. The chilled water is discharged from the mouth 136 into the trough 140 flowing from the chute 141 into the clam chiller (or other apparatus being chilled) causing the warmer water in the clam chiller to flow back through the hose 152. After the set interval on the timer 194 has elapsed the timer contacts close the valve 162 and open the valve 164. During the interval that liquid $CO_2$ was being used in the stack 120, or 122, a small plug of ice may have formed on the respective nozzle 172 or 170 and this is melted later by means of the small amount of relatively warm $CO_2$ gas or vapor which flows thru the valve 190 or 192 and thence thru the respective nozzle 170, 172.

The controls are mounted in a control box 195.

If during the operation the temperature of the water in the apparatus being chilled (e.g. a clam chiller) reaches a pre-set amount, the temperature controller 196 interrupts the electricity to the normally open and normally closed contacts on timer 194 which closes the respective valves 162, 164 whereby a small amount of $CO_2$ vapor is automatically discharged thru both nozzles 170, 172 to prevent water from entering.

The dual stack arrangement 120, 122 allows for rapid cool down by turning both valves 162, 164 on for initial cooling.

A variation may be made for making water ice slush with an operation essentially the same as previously described except that the trough 140 is provided with holes in the bottom to drain off the water and when the slush is formed it slides down thru the trough 140 and out the chute 141.

While I have shown and described a particular apparatus together with a method which may be practiced by the apparatus, this is by way of illustration only and does not constitute any sort of limitation on the scope of my invention since various alterations, changes, deviations, eliminations, revisions, omissions, additions and departurees may be made in the apparatus and method described herein without departing from the scope of this invention as defined only by a proper interpretation of the appended Claims.

What is claimed is:

1. In a device for reducing the temperature of a fluid media and for circulating same:

(a) a container having the fluid media therein, (b) gas releasing means for releasing a coolant gas below the level of said fluid media, (c) a supply means on said container for supplying coolant gas to said gas releasing means whereby the gas is released and permitted to become a liberated volatile gas, (d) gas directing means within said fluid media for directing said released gas within said fluid media and for directing said gas from said fluid media whereby the temperature of the fluid media is reduced, (e) and means on said device for preventing accidental formation of solid between the supply means and gas releasing means.

2. The device claimed in claim 1 said means on said device for preventing accidental formation comprising a means for circulating a small amount of vapor in response to changes of condition of the system. to open to

3. The device claimed in claim 2 said means for circulating comprising a vapor sweep cycle to prevent accidental formation of solidified gas in the supply means and including a valve means, a means for controlling said valve means in response to a change in pressure whereby said valve is caused to maintain the pressure above a specified amount, and control means for said valve means.

4. The device claimed in claim 1 said means on said device for preventing accidental formation including providing a vapor sweep cycle to prevent accidental formation of solidified gas in the supply lines in response to an unwanted pressure drop by supplying a small amount of vapor to maintain the pressure above a specified amount until all liquid has been discharged, and discontinuing said vapor upon the reaching of the desired pressure.

5. The device in claim 1 wherein: said gas is $CO_2$ and the like and said gas is supplied from a source of pressurized liquid, an outlet nozzle located below the level of said fluid media, said gas directing means comprising a space defined within said container and there being openings in said space through which said fluid media passes, a supply line, means for preventing solidification of gas within the supply line comprising a vapoor line in communication at times with said supply line and a control means for permitting said vapor to enter said supply line to prevent the fluid from entering said nozzles.

6. The device in claim 5 wherein there is a float means within said container to control the fluid level, a float switch activated by said float means, circuit means including said float switch, a vapor solenoid controlling the vapor line, and electrically operated switch means for operating said solenoid.

7. The device in claim 6 wherein there is a vapor heater, a pressure reducing valve, and a check valve.

8. The device in claim 1: said means for preventing accidential formation comprising a means for circulating a small amount of vapor within the line in response to changes of condition of the system.

9. The device claimed in claim 8 comprising a vapor sweep cycle to prevent accidental formation of solid in the line and including a valve means, a means for controlling said valve means in response to a change in pressure whereby said valve is caused to open to maintain the pressure below a specified amount, and control means for said valve.

10. In a device for reducing the temperature of a fluid media and for circulating same:

a container having the fluid media therein, a gas directing means located in said tank and extending from the bottom upwardly therefrom, means on said gas directing means comprising openings beneath the level of said fluid media to permit the entry thereof into said directing means, an outlet nozzle located within said gas directing means and below the level of said liquid media but above the level of said openings in said confined space, a supply means on said container for supplying pressurized liquid $CO_2$ gas to said nozzle whereby the liquid $CO_2$ is released from said nozzle above said openings and permitted to become a liberated volatile gas, means for maintaining the proper level of said fluid media within said tank, and means for supplying pressurized liquid $CO_2$ to said supply line.

11. The device claimed in claim 10 wherein there is a means on said device for preventing accidental formation of solid $CO_2$ in the line and said means comprising a means for circulating a small amount of vapor within the line in response to changes of condition of the system.

12. The device claimed in claim 11 comprising a vapor sweep cycle to prevent accidental formation of solid $CO_2$ gas in the line and including a valve means, a means for controlling said valve means in response to a change in pressure whereby said valve is caused to open to maintain the pressure below a specified amount, and control means for said valve above said inlets and releasing said $CO_2$ to said fluid media whereupon said $CO_2$ becomes a volatile gas which moves and engages said fluid media in said confined space, directing said fluid within said closed space by said gas and in contact with the endothermic reaction thereof thereby reducing the temperature, and separating of said $CO_2$ gas from said liquid media whereby the gas is substantially free thereof to be removed, removing said gas and directing said fluid media back into said container.

* * * * *